US005600339A

United States Patent [19]

Oros

[11] Patent Number: 5,600,339

[45] Date of Patent: Feb. 4, 1997

[54] ANTENNA

[76] Inventor: Edward A. Oros, 2629 Sapling Dr., Allison Park, Pa. 15101

[21] Appl. No.: 349,807

[22] Filed: Dec. 6, 1994

[51] Int. Cl.[6] ..... H01Q 9/04

[52] U.S. Cl. ..... 343/825; 343/827; 343/837

[58] Field of Search ..... 343/824, 825, 343/827, 828, 837; H01Q 9/04

[56] References Cited

U.S. PATENT DOCUMENTS

| | | | |
|---|---|---|---|
| 1,831,921 | 11/1931 | Martin | 343/828 |
| 2,124,424 | 7/1938 | Leeds | 343/825 |
| 2,334,279 | 11/1943 | Neiman | 343/825 |
| 2,647,211 | 7/1953 | Smeby | 343/828 X |
| 2,789,286 | 4/1957 | Marshall | 343/824 |
| 3,122,745 | 2/1964 | Ehrenspeck | 343/837 X |
| 4,138,681 | 2/1979 | Davidson et al. | 343/825 X |
| 4,259,673 | 3/1981 | Guretzky | 343/825 |
| 4,644,364 | 2/1987 | Parks | 343/825 |
| 5,406,295 | 4/1995 | Baranski et al. | 343/825 X |
| 5,451,971 | 9/1995 | Grossman et al. | 343/828 |

FOREIGN PATENT DOCUMENTS

| | | | |
|---|---|---|---|
| 1265056 | 5/1961 | France | 343/795 |
| 0688040 | 2/1953 | United Kingdom | 343/825 |

OTHER PUBLICATIONS

Hall et al, *The ARRL Antenna Book,* 1983, pp.

*Primary Examiner*—Donald T. Hajec
*Assistant Examiner*—Steven Wigmore
*Attorney, Agent, or Firm*—Ansel M. Schwartz

[57] ABSTRACT

An antenna comprising a first conductive element having a first end and a second end. The antenna is also comprised of a second conductive element having a first end and a second end. The second conductive element is adjacent and essentially in parallel to the first conductive element. The antenna is also comprised of a third conductive element connected to the first conductive element and second conductive element at their first ends therewith so signals in the third conductive element can pass to the first conductive element and second conductive element.

8 Claims, 7 Drawing Sheets

ANTENNA

FIELD OF THE INVENTION

The present invention is related to antennas. More specifically, the present invention is related to an antenna having a first conductive element, a second conductive element essentially in parallel with the first conductive element, and a third conductive element connecting the first and second conductive elements at one end.

BACKGROUND OF THE INVENTION

Antennas are an integral component of any radio based communication system. In many instances, space is at a premium for radio users. A traditional beam antenna (which may have element spacings a quarter of a wavelength apart) may be unusable because the necessary space is unavailable. Such beam antennas normally have a low impedance and require matching networks. All of this adds complexity to the antenna. The present invention is an antenna that requires minimal space, has low system losses and yet has gain equivalent to larger, traditional beam antennas. Furthermore, the present invention may be used in the design of larger arrays which utilize less components or do not require matching devices, and still provides the same gain as historic devices.

SUMMARY OF THE INVENTION

The present invention pertains to an antenna. The antenna comprises a first conductive element having a first end and a second end. The antenna is also comprised of a second conductive element having a first end and a second end. The second conductive element is adjacent and essentially in parallel to the first conductive element. The antenna is also comprised of a third conductive element in communication with the first conductive element and second conductive element at their first ends and preferably perpendicular therewith so signals in the third conductive element can pass to the first conductive element and second conductive element.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
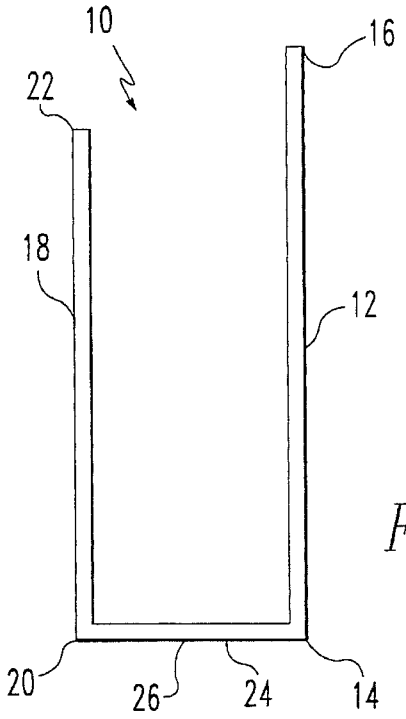
FIG. 1 is a schematic representation of an antenna of the present invention on an X/Y graph.

Referring now to the drawings wherein like reference numerals refer to similar or identical parts throughout the several views, and more specifically to FIG. 1 thereof, there is shown an antenna 10. The antenna 10 comprises a first conductive element 12 having a first end 14 and a second end 16. The antenna 10 is also comprised of a second conductive element 18 having a first end 20 and a second end 22. The second conductive element 18 is adjacent and essentially in parallel to the first conductive element 12. The antenna 10 is also comprised of a third conductive element 24 in communication with and preferably connected to the first conductive element 12 and second conductive element 18 at their first ends 14, 20, for example, with capacitance or inductance or directly connected, and preferably perpendicular therewith so signals in the third conductive element 24 can pass to the first conductive element 12 and second conductive element 18.

Figure 13:
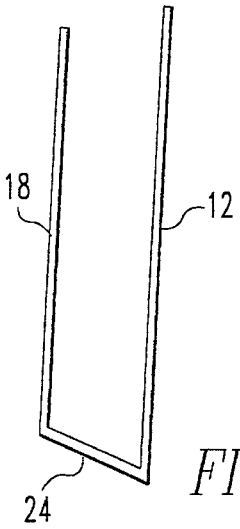
FIG. 13 is a schematic representation of an alternative embodiment of an antenna of the invention.

Preferably, the first conductive element 12 has a length which is greater than a length of the second conductive element 18. Preferably, the second conductive element 18 is in front of the first conductive element 12 so the gain is in the direction of the smallest element. Preferably, the length of the first conductive element 12 is equal to 463.125 divided by the frequency of the signal in megahertz. Preferably, the length of the second conductive element 18 is equal to 448.875 divided by the frequency of the signal in megahertz. Preferably, the length of the third conductive element 24 is equal to (983.6 divided by the frequency of the signal in megahertz)×0.06. However, depending on the application, the first conductive element 12, second conductive element 18 and third conductive element 24 are not limited to these lengths but can be essentially any relationship. In an alternative embodiment, the length of the first conductive element 12 is equal to 460.2 divided by the frequency of the signal in megahertz. The length of the second conductive element 18 is equal to 445.5 divided by the frequency of the signal in megahertz. The length of the third conductive element 24 is equal to the distance between the first end of the first and second conductive elements. FIG. 13 shows this alternative preferred embodiment. In this instance, forward gain is 5.06 dBd, F/B is 7.36 dB, azimuth beamwidth is 65° and elevation beamwidth is 109°. The first and second conductive elements form an angular relationship with the third conductive element 24.

The antenna 10 preferably includes a feed point 26 (where the antenna 10 may be split) attached to the third conductive element 24 through which a signal having a frequency is introduced to the third conductive element 24. Alternatively, the feed point 26 can be at the center or the top of either the first or second conductive elements. If the feed point 26 is on either the first conductive element 12 or second conductive element 18, then the signal goes from that element to the third conductive element 24 and then to the element on the other side.

The first conductive element 12, second conductive element 18 and third conductive element 24 can be made out of tubing or wire. If desired, a non-conductive separator 28 or multiple separators can be placed between the first conductive element 12 and second conductive element 18 to maintain and support the first conductive element 12 and second conductive element 18 apart from each other.

In the operation of the preferred embodiment, the antenna is comprised of two parallel pieces 12, 18 of conductive material (wires, tubing, etc.). These two parallel pieces 12, 18 are connected to each other by a third piece 24 of conductive material (wire, tubing, etc.) at just the first ends 14, 20 of the two parallel pieces 12, 18. One inch tubing or greater is preferred for the entire antenna 10 to reduce losses, provide maximum gain and also to provide better impedance numbers which makes matching easier.

Figure 2:
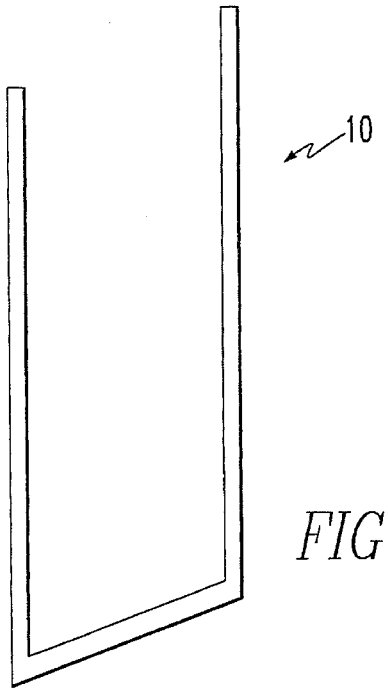
FIG. 2 is a schematic representation of the antenna of the present invention.
Figure 3:
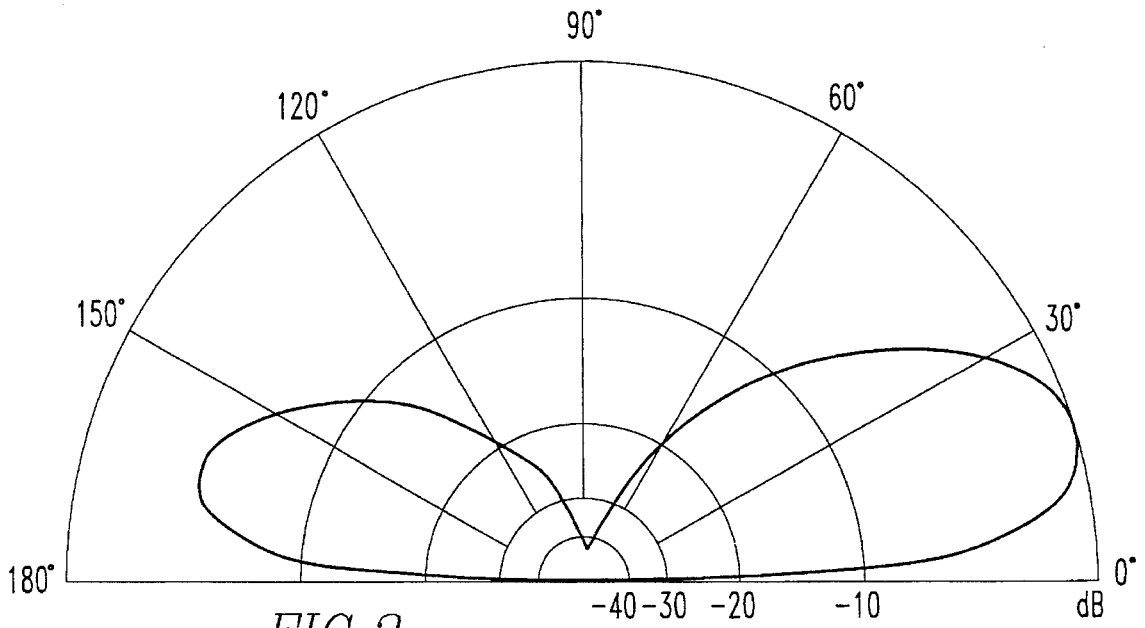
FIG. 3 is a depiction of the antenna pattern of the vertical configuration of the present invention with the base of the antenna at one foot above ground.
Figure 4:
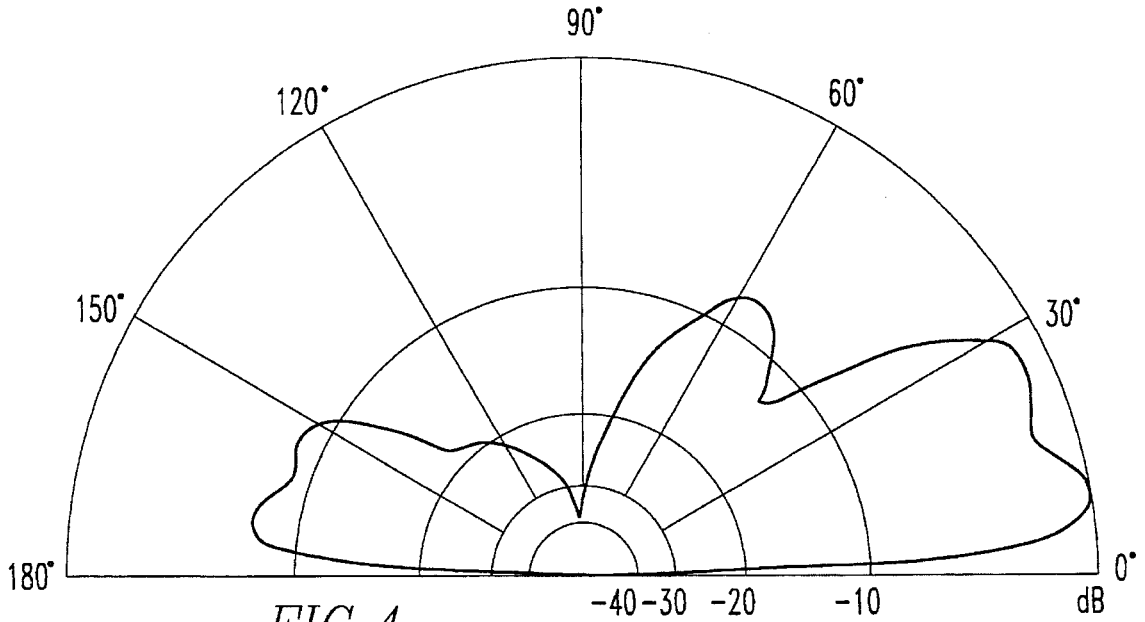
FIG. 4 is a depiction of the antenna pattern of the vertical configuration with the base of the antenna at thirty feet above ground.
Figure 5:
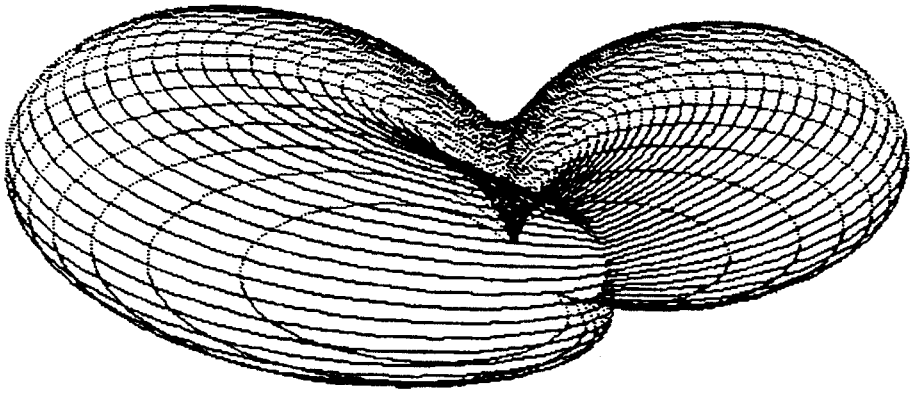
FIG. 5 is a three-dimensional representation of the antenna pattern of FIG. 3.
Figure 6:
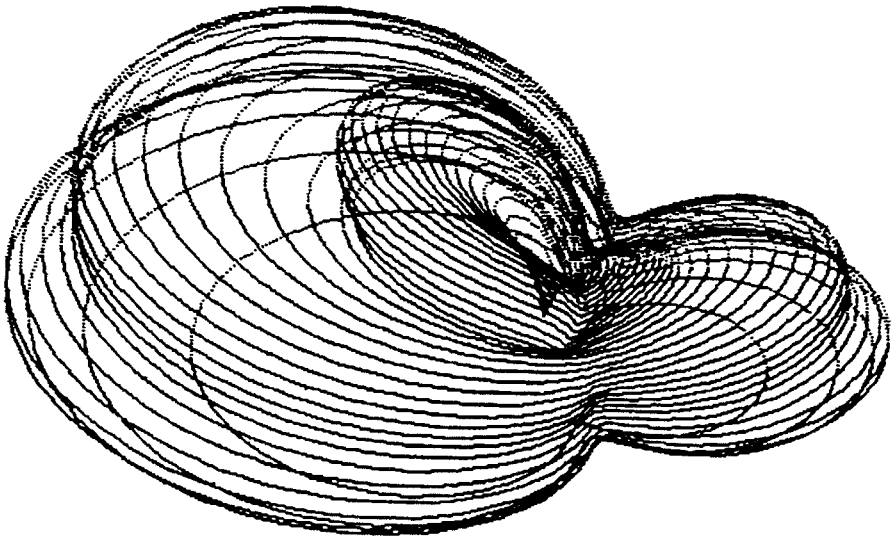
FIG. 6 is a three-dimensional representation of the antenna pattern of FIG. 4.

FIG. 1 shows the antenna 10 on an X/Y graph, FIG. 2 shows just the antenna 10 alone. Both FIGS. 1 and 2 display the antenna 10 in a vertical configuration, although it may of course be used at any angle, depending on the station's requirements. FIG. 3 and FIG. 4 show the antenna 10's patterns of the vertical configuration with the base of the antenna 10 at one foot above ground and also at thirty feet above ground, respectively. FIG. 5 and FIG. 6 show three dimensional patterns of FIGS. 3 and 4, respectively. The antenna 10 was rotated to the left to provide better clarity on the three-dimensional patterns.

Figure 7:
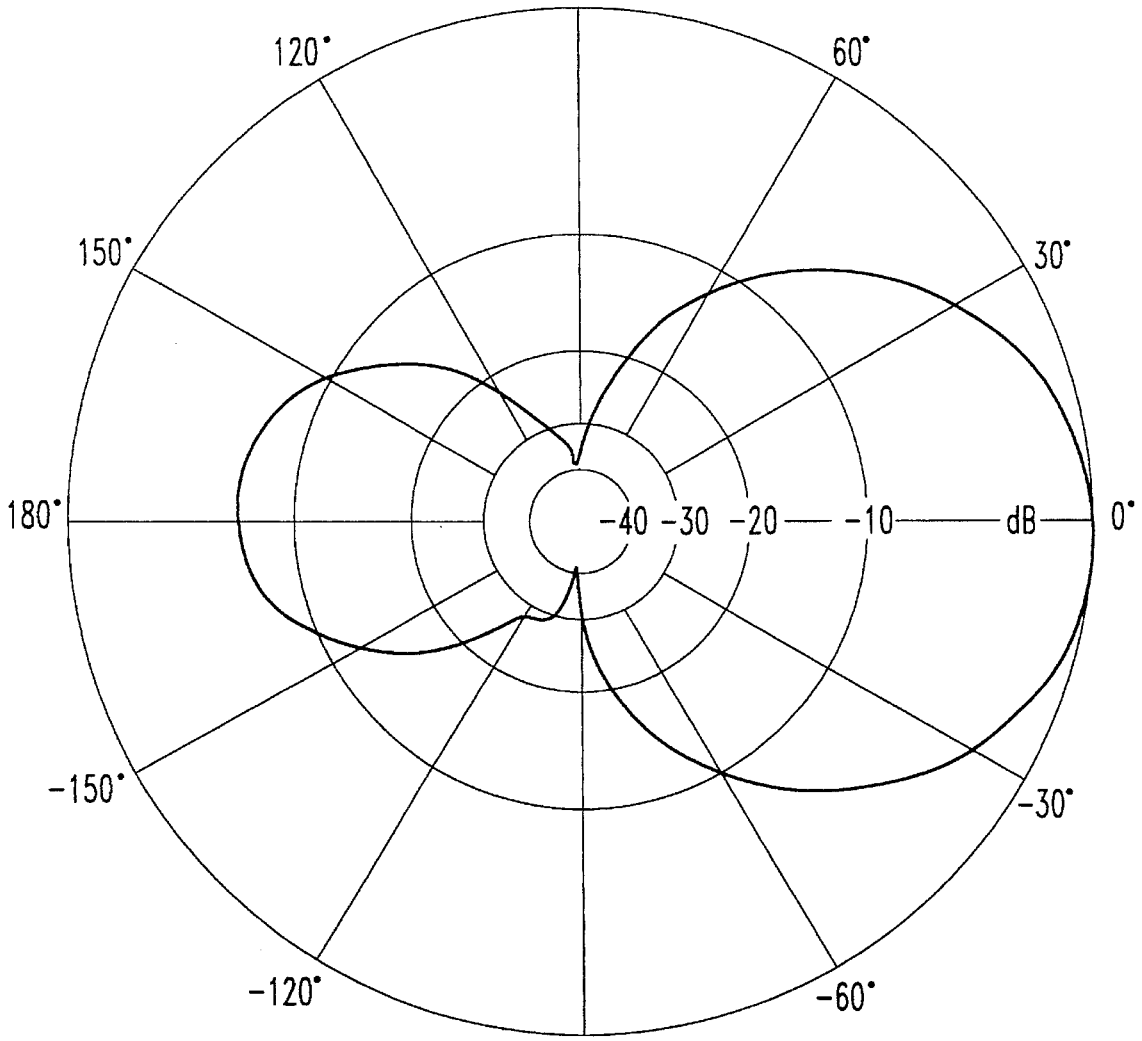
FIG. 7 shows the free space elevation gain of the invention.
Figure 8:
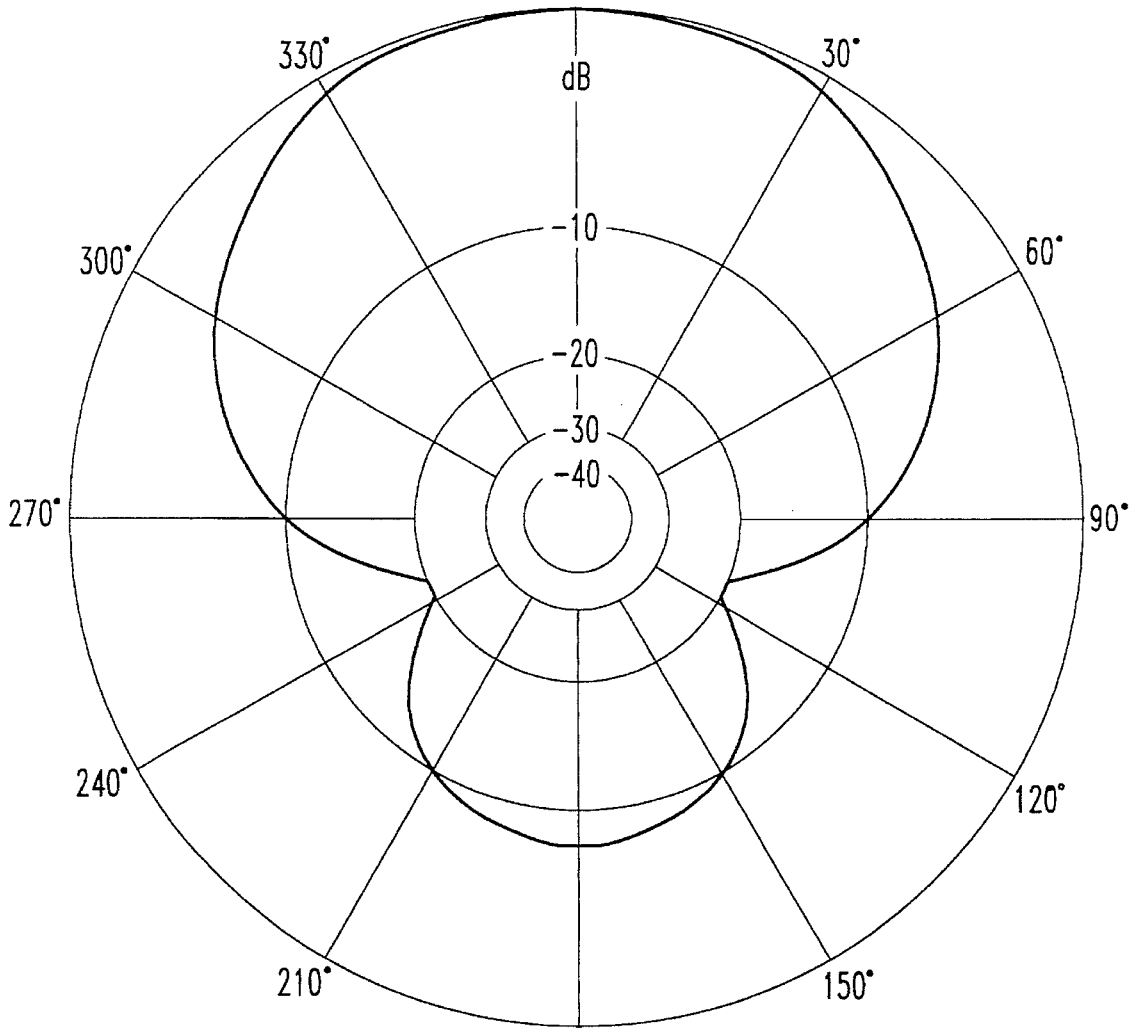
FIG. 8 shows the free space azimuth gain of the invention.

FIG. 7 and FIG. 8 show the corresponding free space elevation and azimuth gain. These are very important, the antenna gain of this antenna 10 is greater than 5 dBd when fed at the feed point 26 at the bottom. This is accomplished with very small element spacing (for example, two feet spacing for an antenna 10 for the ten meter band [28.5 Mhz]). A traditional two element beam at these spacings has very low radiation resistance and therefore the resistive losses make the whole system inefficient. If the antenna 10 is fed at the center of the first piece 12 or the second piece 18, it behaves much as does a folded dipole, the currents are no longer out of phase, so there is almost no gain, but the antenna 10 has other properties that are useful in this case. Here, the impedance steps up, but not for the same reasons as in a folded dipole (or folded mono-pole). In a folded dipole, the current is forced to split between two wires and this causes the step-up of the impedance. The impedance step up in the antenna 10 is more the result of the antenna 10 being fed as a Harmonic Antenna. A folded dipole is similar except both ends of the antenna are connected to force the currents in phase.

Figure 9:
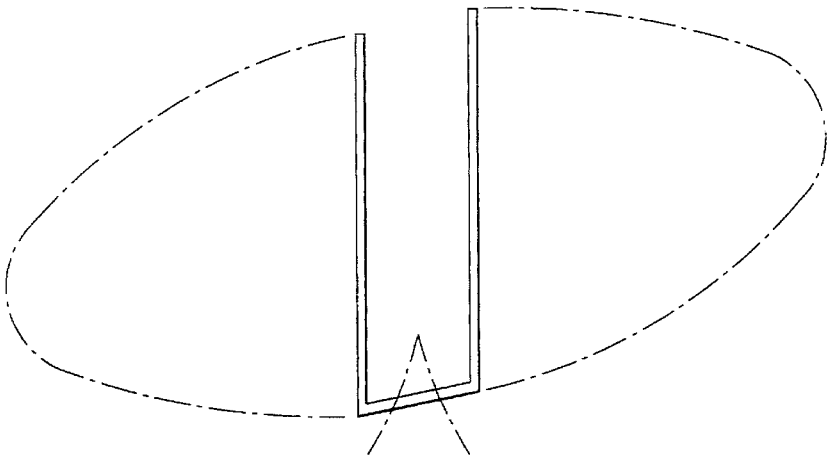
FIG. 9 is a schematic representation of the antenna with antenna currents displayed.
Figure 10:
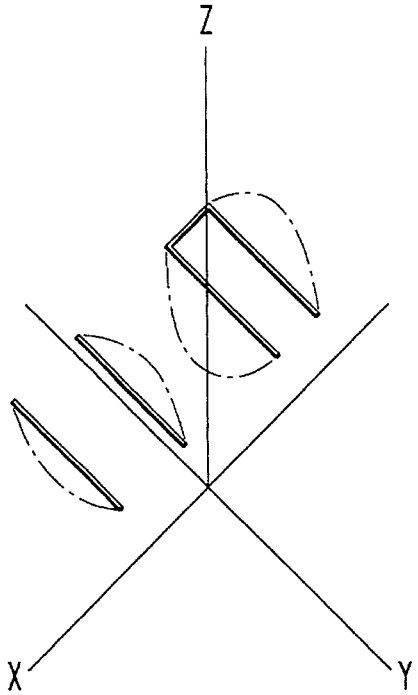
FIG. 10 is a schematic representation of a four element antenna of the present invention depicted in the X/Y plane showing antenna currents.
Figure 11:
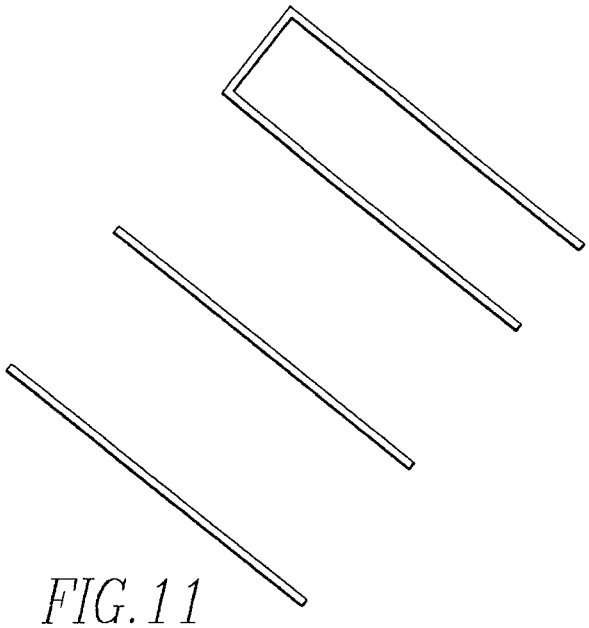
FIG. 11 is a schematic representation of a four element antenna of the present invention.
Figure 12:
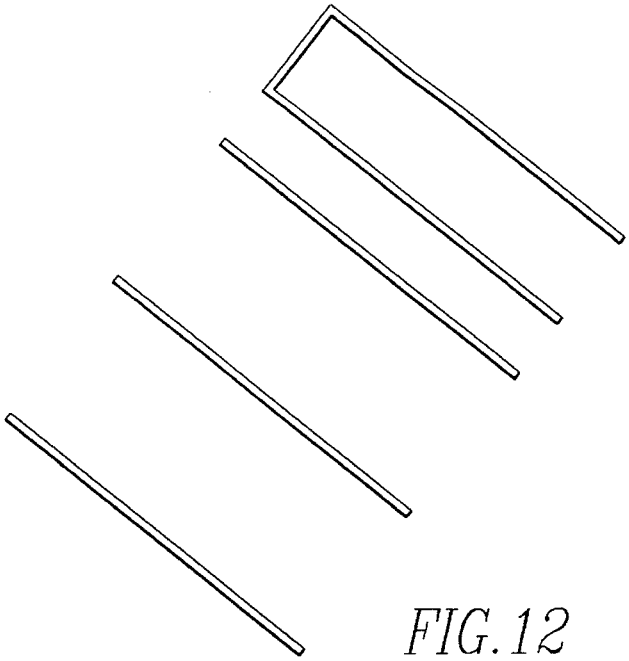
FIG. 12 is a schematic representation of a five element antenna of the present invention.

FIG. 9 is of the antenna 10 with the antenna currents displayed. With the antenna 10 used in a configuration, as shown in FIG. 12, a five element beam can be formed (a typical classical design would have a low impedance and require matching networks) having a feed point impedance of fifty ohms, which means it can be fed directly by coax cable and no matching device, yet still have a gain of 9+dBd. The addition of directors as additional elements is well known in the art. By feeding the antenna 10 at the end, an antenna can be created using only 4 elements (including the two elements of the original design) and yet produce the same gain as a traditional 5 element beam (see FIGS. 10 and 11). For the antenna of FIG. 11,

| | |
|---|---|
| Wire Losses | 0.27 dB |
| Efficiency | 93.9% |
| Forward Gain | 9.16 dBd |

-continued

| | |
|---|---|
| F/B | 10.16 dB |
| Azimuth Beamwidth | 45° |
| Elevation Beamwidth | 54° |

The antenna 10 can be constructed using the following information. There are a total of three elements involved in the design. There are two parallel elements. The length of the first conductive element 12 is obtained by the following formula. 463.125 divided by the frequency in megahertz. The length of the second conductive element 18 is obtained by the formula 448.875 divided by the frequency in megahertz. Maximum gain would occur when the two elements are placed in front of each other and the smaller second conductive element 18 centered in relation to the larger one. Optimum spacing between elements should be approximately 6 percent of the free space wavelength ((983.6/Frequency in megahertz) times 0.06). The third conductive element 24 connects the two parallel elements at their first end 14, 20.

The above lengths are based on optimum forward gain. The feed point for the above formulas assumes a feed point 26 in the center of the third conductive element 24 which connects the 2 parallel elements. All elements should have a large diameter in order to reduce losses, produce maximum gain and to keep the impedances manageable. For example, a 1 inch diameter is optimum for use in the Amateur Radio 10 meter band (EG: 28.5 mHz). Element diameters should be proportioned based on the actual design frequency. In order to maintain the same formulas described above, the diameter would approximately double for the 20 meter band and quadruple for the 40 meter band.

As with any antenna design, the lengths can differ depending on the gain, impedance, front to back and so forth desired by the user. These formulas do not have to be adhered to exactly. The smaller element can be positioned so one end is level to the back element, with little loss in gain. This allows the bottom element to be straight for easier mechanical construction. A wire antenna design is even possible by adjusting the element lengths and spacing. The resulting antenna would have the same basic shape but would have less gain and a higher mismatch to traditional 50 ohm cable.

Operation of the antenna 10 changes based on the feed point 26 and differs greatly depending on the location selected. When fed at the center of the third conductive element 24, the two parallel element(s) currents are out of phase and therefore, the antenna 10 provides gain in the direction of the second conductive element 18 (when using the above formulas). If the antenna 10 is fed at the center of one of the two parallel elements, the antenna 10 behaves similar to that of a traditional folded dipole antenna. The parallel elements are now in phase and the impedance is approximately 300 ohms.

One of the antenna's many benefits is that it allows the creation of an extremely close spaced beam. People who just don't have the available space to erect a traditional beam antenna (which may have element spacings a quarter of a wavelength apart!), can now obtain the same gain at just 0.06 wavelengths or less. For example, a rotatable vertical beam for the 10 meter band can be created with a turning radius of just 2 feet and yet it produces over 5 dBd gain.

A comparison of a typical traditional 2 element beam to the antenna 10 design (using 2 parallel elements and a connection on just one end) will more clearly show the benefits of the antenna 10. Directors and reflectors will be omitted for the moment.

Using the traditional design, the theoretical maximum gain occurs at approximately 0.06 wavelengths and has just above 5 dBd gain. Unfortunately, the theoretical antenna and the real life results differ. Making the two elements stable enough is just the first problem. With closed spacing also comes a low radiation resistance on the order of 4 to 8 ohms! This in itself can cause matching headaches, since most commercial radio equipment is designed to match 50 ohms. Matching to such a low impedance is difficult. The low radiation resistance plus the higher currents and voltages necessitate the reduction of any and all system losses (skin effect wire loss, end losses, and ground loss.) Otherwise, much of the radio signal will be lost in heat. (Efficiency= radiation resistance)/(radiation resistance+losses). With a 4 ohm impedance, as little as 4 ohms of total losses drops the efficiency to 50 percent.

The answer to these problems is the antenna 10. The very structure of the antenna 10 solves the mechanical stability problem. The end connection of the third conductive element 24 at the first end 14 of the first conductive element 12 physically supports the second conductive element 18 and helps keep it at the correct spacing. This can also be used as a support connection for a mast when the antenna 10 is used vertically.

The antenna 10 inherently has a higher impedance feed point 26, making the losses discussed above much less important, while at the same time making matching a simpler process.

As the antenna 10 is expanded (see FIG. 12), there are other advantages over the traditional designs that become apparent. By adding directors or reflectors as is well known in the art, for example, it is possible to design a 5 element beam (total of 5 half wave elements) that has over 9 dBd gain. For the antenna 10 of FIG. 12:

| | |
|---|---|
| Impedance | 54.1 + j 0.6; |
| SWR | 1.08 |
| Wire Losses | 0.11 dB |
| Efficiency | 97.6% |
| Forward Gain | 9.07 dBd |
| F/B | 14.66 dB |
| Azimuth Beamwidth | 46° |
| Maximum Sidelobe | 11.21 dB down at 80° Elevation |
| Elevation Beamwidth | 55° |

The traditional design would also have this amount of gain, but the impedance would be low, requiring a matching device. Using the antenna 10, a 50 ohm impedance can be obtained thus saving the cost and time required to match the antenna 10. The same gain can also be achieved with just 4 elements (see FIG. 11), if end feeding is employed! A matching network would be required in this case, but the total cost required for materials is reduced by ⅕ because of the reduction in the number of elements required.

As an example, a generator capable of generating a radio frequency signal corresponding to that which the antenna is designed is inserted into the antenna 10 at the center of the third conductive element 24 of the antenna 10. The antenna 10 is split at that point also, so that one terminal of the generator is connected to the left side of the antenna and the other terminal is connected to the right side. At one specific instant of time, the left side of the generator would be negative and the other side would be positive. Each element of the antenna 10 is close to a half wavelength long. The current will therefore flow down towards the generator on one side and up away from the generator on the other side. The currents are 180 degrees (or nearly so) out of phase. As with the case of standard designed beam antennas, this is the exact same condition that provides the gain of the antenna 10. Of course, in a typical beam, one element is fed and the current is induced into the second element from the electromagnetic field of the first element. Also in a typical beam, such close spacing would produce low radiation resistance causing system loses to reduce the overall gain of the antenna.

It is interesting to note that the antenna 10's unique design gives it both the properties of a collinear antenna (more than one half wave section) and that of a harmonic antenna. In a harmonic antenna, the current changes direction from one half wave section to the next.

The gain of the antenna 10 was first determined by using a computer program designed for just such a purpose. It is an improved version of the MININEC algorithm which was originally developed at the U.S. Naval Ocean Systems Center. The various MININEC and the more accurate NEC programs that are commercially available, have proven themselves to be very accurate over the years. In the case of the antenna 10, the MININEC and the NEC agree within about one half a DB.

More information regarding the original MININEC program may be obtained by contacting the following address: U.S. Department of Commerce, National Technical Information Service, 5285 Port Royal road, Springfield, Va. 22161.

"On the air" tests have been performed, comparing various antenna 10 configurations to a popular half wave vertical antenna. Both antennas were set for use on the Amateur Radio 10 meter band for all of the tests.

In one test, the received signals on various other bands were compared to check the usefulness of the antennas as all band receive antennas. The antenna 10 was fed at the third conductive element 24 with the center conductor and the other connector went to ground. In this case, the currents would be in phase in each element (or nearly so, because of the slight difference in the length of each element). Signal strength of various transmitting stations were determined using a commercial Amateur Radio Transceiver and the built in signal strength meter (S meter). Typically, one 'S' unit is equal to 6 dB and S9 is the highest S unit. Signals higher than S9 are measured in dB over S9. The results are listed below.

| Frequency | Commercial Half Wave Antenna | Antenna |
|---|---|---|
| 10.00 MHz | S0 | S7 |
| 7.3158 MHz | S6 | 18 dB over S9 |
| 3.7866 MHz | S3 | 10 dB over S9 |
| 1.812 MHz | S0 | S9 |

In another test, a signal source was checked on the 10 meter band using both antennas. In this case, the antenna 10 was fed at the bottom of the antenna 10 in the center, and the antenna was split at the feed point to provide the out of phase condition which would produce gain. Tests were made with the source signal vertical and tests also were made with the signal horizontal in polarity. In each case, the antenna 10 produced the expected gain of 5 to 6 dB over the commercial half wave antenna.

Often times, the real value of a 'GAIN' antenna can be seen when trying to work long distance (DX) stations. A band opening of 10 meters to the South Pacific recently helped show the gain difference. Two to three S units better were noticed on the antenna 10 over the commercial half wave antenna in this case.

The antenna 10 has several uses, each which depends on the way the signal is fed to the antenna 10. The following are a few of the possibilities:

1. When fed with just the center conductor to the bottom element 24 of the antenna 10 at feed point 26, and the other conductor fed to ground, the antenna 10 makes an excellent all band (10 through 160 meter) receive antenna. Although not very efficient, (beyond the second harmonic) it may be used with an antenna tuner as a transmitting antenna for these bands also.
2. When fed as described above and used on the 20 meter band (assuming the antenna 10 is designed for the 10 meter band), the antenna 10 is actually operating as a quarter wave on the 20 meter band. The ground could be a ground plane or simply a ground connection. This feature would be true for any designed band. For example, a 20 meter version would work as a quarter wave on 40 meters and so on.
3. When fed at the center of one of the sides of the antenna, the currents are in phase in this case. The antenna then performs like a folded dipole antenna. This can be useful in feeding beam antennas. It is possible in this case to directly feed a 5 element beam (two of the elements are in the antenna 10), that is a direct match to the standard 50 ohm coax. This reduces the antenna's cost, weight, and the time required by the builder to make the antenna operational. The element lengths can be equal in this case and the spacing can be quite flexible. Spacing of just a few inches should be avoided because of the weather related problems. Build up of ice actually will lower the operating frequency of the antenna and its effects are quite noticeable.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An antenna comprising:

a first conductive element, having a first end and a second end, having an electrical length of essentially ½ wavelength at an operation frequency;

a second conductive element, having a first end and a second end, having an electrical length essentially ½ wavelength at said operation frequency, said second conductive element adjacent and essentially in parallel to the first conductive element;

a third conductive element in communication with the first and second conductive elements at their first ends so signals may pass through the first, second and third conductive elements, said third conductive element having an electrical length of essentially 0.06 wavelengths;

a feed point attached to one of said first conductive element, said second conductive element, and said third conductive element.

2. An antenna as described in claim 1 including at least one director or reflector disposed adjacent to the first or second conductive element.

3. An antenna as described in claim 1 wherein the first conductive element in combination with the second conductive element forms a collinear antenna, such that at the same time current in the first and second conductive elements are essentially in opposite directions forming a harmonic antenna.

4. An antenna as described in claim 1 wherein the first, second and third conductive elements are made of tubing or wire.

5. An antenna as described in claim 4 wherein the second conductive element is disposed in front of the first conductive element and said second conductive element is spaced essentially 0.06 wavelengths from said first conductive element.

6. An antenna as described in claim 5 wherein the first conductive element has an electrical length which forms a relation with the second and third conductive elements, thereby producing a hairpin or u-shaped configuration.

7. An antenna as described in claim 6, wherein said feed point is attached to the third conductive element through which a signal having said frequency is introduced to the third conductive element.

8. An antenna as described in claim 6 including a feed point, wherein the feed point is a coupled signal wherein a radio frequency signal may be applied to or obtained from the first, second or third conductive elements.

* * * * *